United States Patent [19]

Merritt

[11] Patent Number: 4,701,142

[45] Date of Patent: Oct. 20, 1987

[54] PADDLE HANDLE ACCESSORY

[76] Inventor: William Merritt, 350 First Ave., New York, N.Y. 10010

[21] Appl. No.: 777,705

[22] Filed: Sep. 19, 1985

[51] Int. Cl.[4] ..... B63H 16/04

[52] U.S. Cl. ..... 440/101; 16/114 R; 294/58; 416/74

[58] Field of Search ..... 440/101, 102, 104; 294/58; 16/114 R; 416/74

[56] References Cited

U.S. PATENT DOCUMENTS

| | | | |
|---|---|---|---|
| 115,584 | 6/1871 | Davenport | 440/104 X |
| 237,891 | 2/1981 | Musselman | 16/114 R |
| 1,534,075 | 4/1925 | Parrish | 16/114 R |
| 2,430,802 | 11/1947 | Catlin | 294/58 |
| 2,653,406 | 9/1953 | Grabiak et al. | 294/58 |
| 3,155,414 | 11/1964 | Bales | 294/58 |
| 3,751,094 | 8/1973 | Bohler | 294/58 |
| 4,155,582 | 5/1979 | Reisner | 294/58 |

FOREIGN PATENT DOCUMENTS

| | | | |
|---|---|---|---|
| 37021 | 1/1927 | Denmark | 294/58 |
| 135100 | 5/1919 | United Kingdom | 294/58 |
| 992320 | 2/1983 | U.S.S.R. | 440/101 |

*Primary Examiner*—Jeffrey V. Nase
*Assistant Examiner*—Paul E. Salmon
*Attorney, Agent, or Firm*—Thomas R. Morrison

[57] ABSTRACT

A handle for attachment to the shaft of a paddle to improve the efficiency and comfort of paddling. The handle having a grip portion and spaced outwardly extending arms on the grip portion. The arms are coupled to the paddle shaft so that the handle is swingable about the paddle shaft and positioned at an angle with respect to the longitudinal axis of the shaft.

8 Claims, 11 Drawing Figures

PADDLE HANDLE ACCESSORY

BACKGROUND OF THE INVENTION

Paddles for propelling small boats or vessels have been known for many years. Such devices have consisted of a flattened blade portion, an elongated shaft, usually integral with the blade, and a grip (hereinafter a "palm grip") on the end of the shaft opposite the blade. The paddle is usually made of some suitably rigid material such as wood, aluminum, plastic or the like. Light weight and strength to resist the forces imposed upon it are important considerations in the manufacture of paddles.

In using a paddle, it is grasped with one hand on the shaft and the other hand upon the palm grip. The paddle is dipped into the water along side of the boat and at a point in front of the user. The paddle is then pulled toward the user by the shaft portion while pressure in the opposite direction is applied to the palm grip. As the paddle is thus moved through the water, an opposite force acting through the body of the user is applied to the boat causing it to move forward through the water. It is also necessary to guide the path of the paddle as it is being pulled in order to keep the boat on course, since paddling on one side of the boat will cause it to turn. A preferred stroke in paddling to accomplish this correction is known as "J" ing or a "J" stroke.

As even experienced paddlers will recall, prolonged paddling with conventional paddles is not only very tiring, but likely to cause blistering of the skin, particularly in the area between the thumb and forefinger. One of the principal reasons for paddling discomfort is the fact that almost all of the force applied to the paddle shaft is transmitted by only two fingers (the fore and index fingers) and in an awkward and loose gripping position. In addition, the paddle has to be given a rotating motion about its longitudinal axis and therefore across the skin of the hand. The result is a gradual loss of efficiency of the paddling.

Accordingly, it is an object of the present invention to provide a handle for attachment to a paddle shaft which will overcome the shortcomings of the conventional paddle.

Another object of the present invention is to provide a handle for a paddle which will improve the performance of both the novice and expert paddler.

A further object of the present invention is to provide a handle for a paddle which does not substantially increase the weight of the paddle, is interchangeable with a wide variety of paddles and is comfortable to use from the standpoint of human engineering.

SUMMARY

A handle made in accordance with the present invention comprises an upper arm portion, a lower arm portion, both adopted for attachment to the shaft of a paddle and a grip interconnecting the two arms. The grip is oriented in such manner that it is disposed at an angle of in the order of 25°-34° with respect to the longitudinal axis of the paddle shaft. The upper end of the grip is closer to the paddle shaft than the lower.

BRIEF DESCRIPTION OF THE DRAWINGS

In the accompanying drawings, forming part hereof, similar elements have been given the same reference numerals, in which drawings.

DETAILED DESCRIPTION OF THE INVENTION

Figure 1:
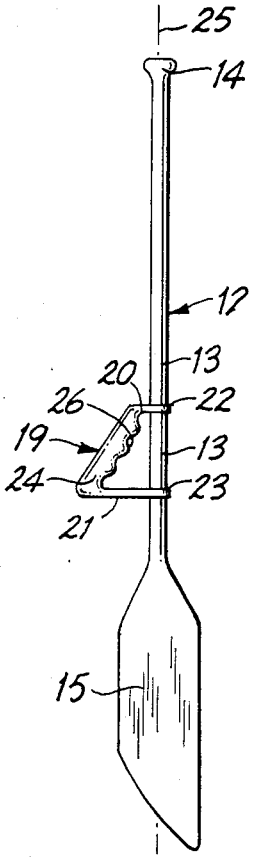
FIG. 1 is a view in elevation of a paddle in accordance with the present invention.
Figure 2:
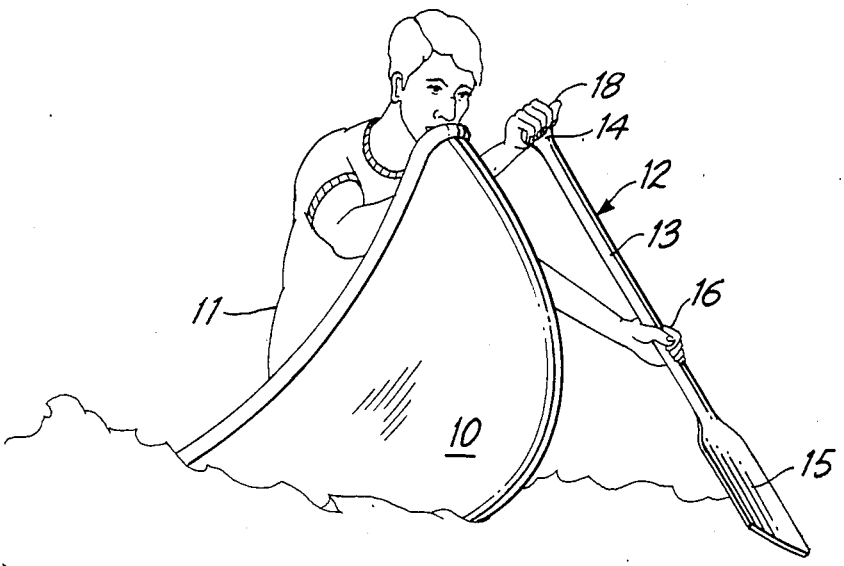
FIG. 2 (PRIOR ART)
FIG. 2 is a view in perspective of a person using a canoe paddle in accordance with the prior art.
Figure 2A:
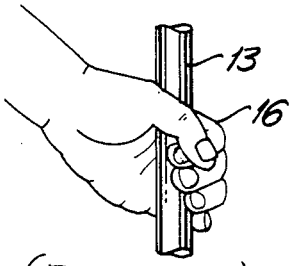
(PRIOR ART) FIG. 2a
FIG. 2*a* is a detailed view of the canoeist's hand shown in FIG. 2.

Referring to the drawing and particularly FIGS. 1–4, there is shown the bow and stern portions of a canoe 10. In FIG. 2 a canoeist 11 is illustrated using a paddle 12, made in accordance with the prior art. The paddle consists of an elongated shaft 13 having a palm grip 14 at the upper end thereof and a flattened blade 15 at the opposite or lower end of the shaft, the shaft having a longitudinal axis which passes through the blade and the palm grip. The palm grip and blade are usually integral with the shaft although the present invention may be used with any paddle to which it may be attached as hereinafter more fully described. The canoeist 11 in FIG. 2 grasps the paddle shaft 13 with one hand 16 and the palm grip 14 in the other hand 18. In order to get the most power with each stroke the canoeist reaches forward as far as he can comfortably extend the paddle blade and dips it onto the water. This reaching motion causes the canoeist's grip to open and the fingers of the canoeist's hand 16 to become extended, losing contact with the shaft 13 (see FIGS. 2 and 2*a*), thereby putting considerable pressure on the extended fingers. The paddle is then pulled rearwardly to a position aft of the canoeist to complete the stroke. As the paddle blade is moved through the water, it is turned about its longitudinal axis 25 to act as a rudder to provide course correction. An uncorrected stroke tends to turn the canoe around. As a result of this twisting action, the shaft is rotated across the palm of the canoeist causing a weakening of the grip and possible blistering of the hand.

Figure 3:
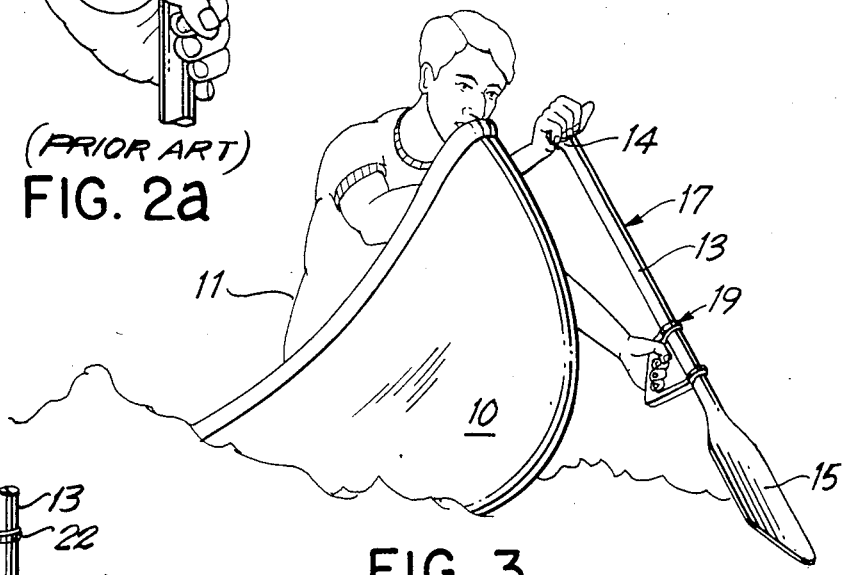
FIG. 3 is a view similar to FIG. 2 showing a paddle used in accordance with the present invention.
Figure 3A:
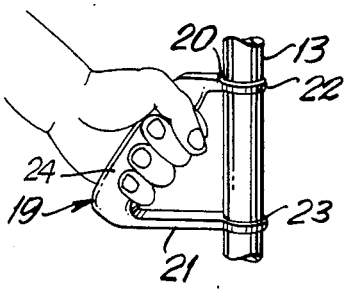
FIG. 3*a* is a detailed view of the canoeist's hand and a paddle handle made in accordance with the present invention shown in FIG. 3.
Figure 4:
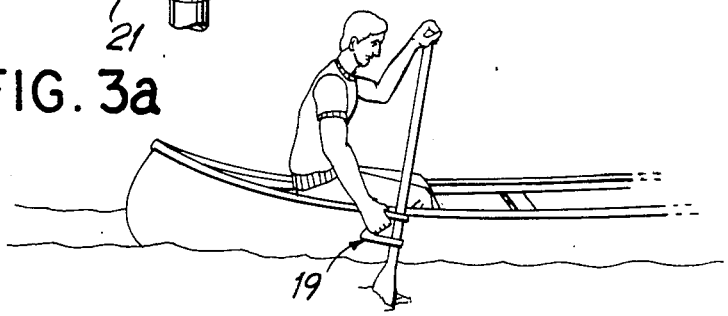
FIG. 4 is a side view of a paddle in accordance with the present invention in use.

A paddle 17 in accordance with the present invention is shown in FIGS. 1, 3 and 4 where it will be seen that handle 19 has been secured to the shaft 13 of the paddle 17.

The handle 19 generally comprises a first or upper arm 20, a second or lower arm 21 and a grip 24 interconnecting the side arms. The arms are each coupled at their free ends 22, 23 to the shaft 13 in such manner that the shaft is rotatable about its longitudinal axis 25 with respect to the handle.

To facilitate the use of the handle and improve the amount of force which the canoeist can bring to bear upon the paddle at all times, the grip 24 is carried at an angle of in the order of 25° to 34° with respect to the longitudinal axis of the shaft 13, as best shown in FIG. 1. The upper arm 20 is therefore made shorter than the lower arm 21 to produce the proper angular position of the grip 24. The angle of the grip may be selected depending upon the position the canoeist prefers to attach the handle to the shaft and upon his position in the canoe, as for example seated or kneeling. The grip 24 may be formed with finger receiving recesses 26 to prevent hand slippage and for proper finger location.

At the beginning of the paddling stroke, as best shown in FIG. 3, the canoeist reaches forward as far as possible with the tip of the paddle just above the surface of the water. Due to the angle of the handle grip his wrist will be straight and the grip firmly within the palm and fingers. The other hand of the canoeist will be on the palm grip 14 in the conventional position. The paddle is then thrust downwardly into the water to the proper depth and the paddle drawn back alongside the canoe until the completion of the stroke. As a result of the angular disposition of the grip portion of the handle, the canoeist's wrist remains substantially unbent throughout the stroke, greatly reducing fatigue and all the fingers of the hand firmly close about the handle (see FIGS. *3a*, 4 and 5). Any steering motion required to maintain course such as is known as "J" ing is produced by twisting the palm grip without disturbing or loosening the canoeist's hold upon the handle grip 24.

It will be apparent that the above described handle may be used by a canoeist at the bow or stern of the canoe. Moreover, the paddle and handle can be used on either side or shifted from one side to the other as desired. The assembly may be used for back water strokes as well as forward strokes without modification or interruption of use.

The manner by which the handle 19 may be swingably secured to the shaft 13 of paddle 12 is shown in the three embodiments shown in FIGS. 5–8.

Figure 5:
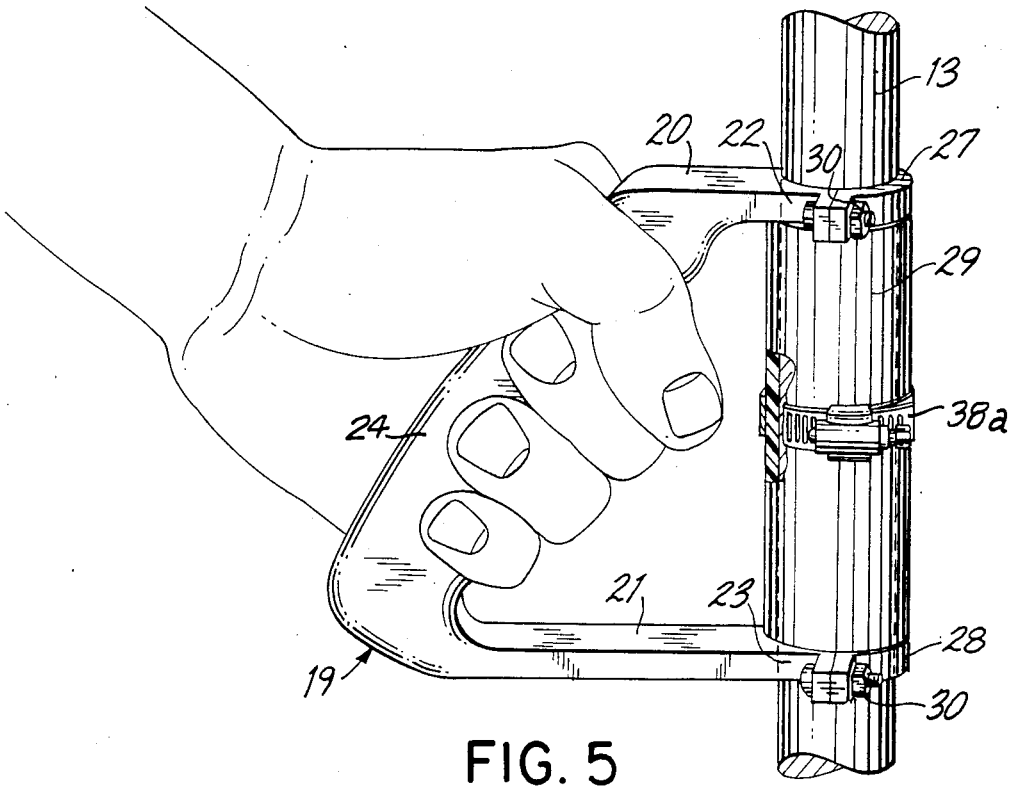
FIG. 5 is a canoe paddle handle on an enlarged scale, partly broken away, made in accordance with the present invention.

In FIG. 5 the arms 22, 23 each terminate in rings 27, 28 which are journaled upon the shaft and restricted in their vertical movement by a sleeve 29 upon the paddle shaft 13. The rings 27, 28 may be split rings for ready attachment to the shaft or solid rings (see FIG. 6). The sleeve 29 may be made in two pieces for ready attachment to the shaft of the paddle by a clamp 38.

Figure 6:
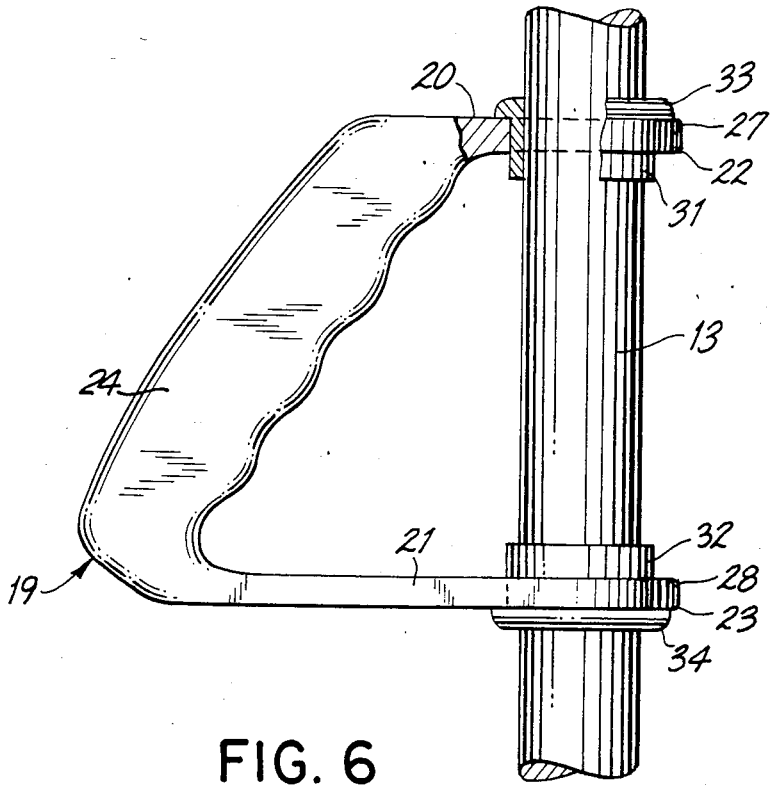
FIG. 6 is a view similar to FIG. 5 of a second embodiment of the present invention.

FIG. 6 shows a second embodiment of the invention in which two collars 31, 32 are slipped around the shaft 13. The collars are flanged at one end thereof as shown at 33, 34 and bear against the rings 27, 28 to limit the upward or downward movement of the handle 19 during use. The rings 27, 28 may be secured to the collars 31, 32 so that the rings rotate upon the collars or alternately, so that the collars are journaled upon the shaft 13 and the rings are fixed to the collars. This latter arrangement may be achieved by coating the exterior surface of the collars with a material such as an elastomer having a high coefficient of friction.

Figure 7:
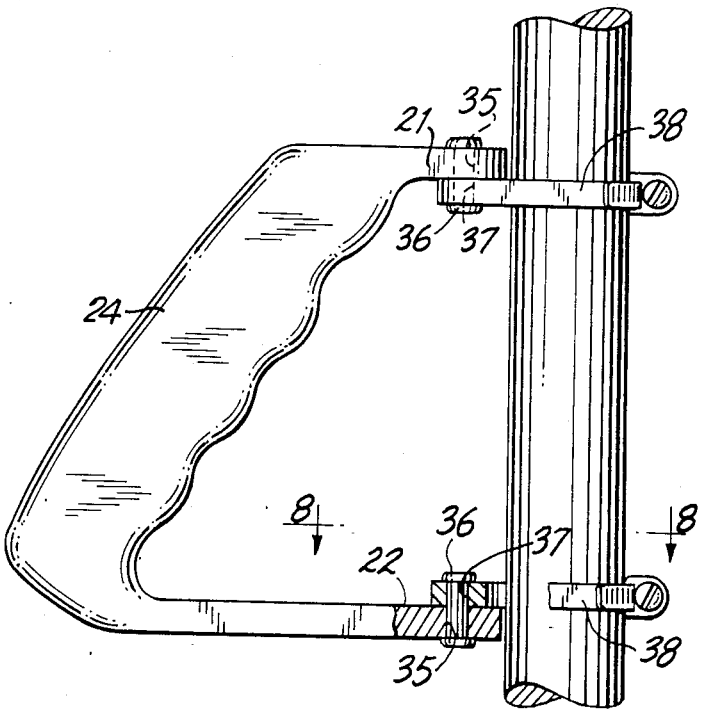
FIG. 7 is a view in side elevation, partly broken away, showing a third embodiment.
Figure 8:
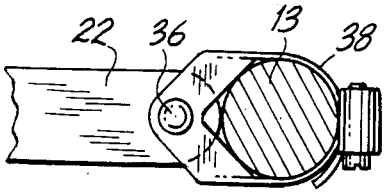
FIG. 8 is a sectional view taken on line 8—8 in FIG. 7.

In the embodiment of FIG. 7, the arms 21, 22 terminate short of the shaft 13 and are transversely bored as indicated at 35 to receive stub shafts 36 which are also received within bores 37 in an adjustable screw clamp 38. The handle is thus pivotally and swingably coupled to the paddle shaft 13. This adjustable clamp arrangement is particularly useful on paddle shafts of different thicknesses or cross-sectional shapes such as the oval shaped shaft.

Figure 9:
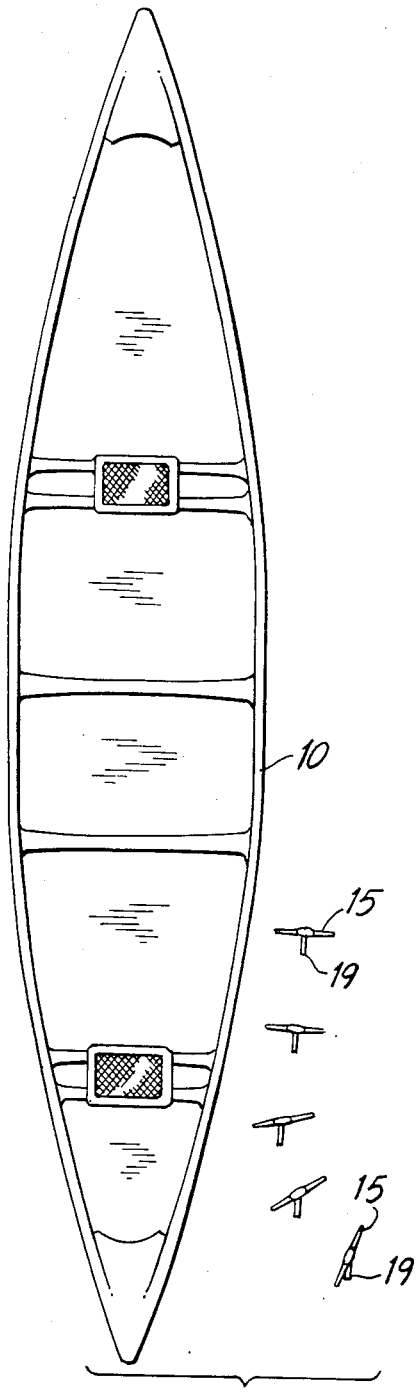
FIG. 9 is a somewhat diagrammatic top view of a canoe showing the various positions taken by a paddle during use.

Referring to FIG. 9, there is shown somewhat diagrammatically the several positions of a paddle blade 15 with respect to a canoe as the blade is pulled through the course correcting "J" stroke alongside the canoe 10. It will be seen that although the angle of the blade 15 changes, particularly at the finish of the stroke, the position of the handle 19 remains substantially unchanged so that the canoeist's wrist is straight and the pull remains substantially parallel with the longitudinal axis of the canoe.

It will be seen that there has been provided a handle for ready attachment to a paddle which will improve the efficiency and comfort of the paddle user during all of the normal paddle positions, which is compatible with most commonly used paddles, and which will not add greatly to the weight of the assembly.

Having thus fully described the invention, what is desired to be claimed and secured by letters patent is:

1. A paddle comprising:

a blade;

a shaft having a longitudinal axis;

said shaft being affixed at a first end thereof to an upper end of said blade;

a palm grip at a second end of said shaft;

said blade and palm grip having said longitudinal axis passing therethrough;

a handle disposed intermediate said first and second ends;

said handle including a grip inclined for general alignment with a hand of a user when paddling with said paddle, whereby paddling can be performed with a substantially straight wrist;

first means for connecting an upper end of said handle to said shaft intermediate said first and second ends;

second means for connecting a lower end of said handle to said shaft intermediate said first and second ends and closer to said first end than said first means for connecting; and said first and second means including means for permitting said shaft to twist a substantial angular amount about said axis during said padding without said handle being rotated in the hand of the user, whereby substantially more comfortable paddling is enabled.

2. A paddle according to claim 1 wherein;

said first and second means include first and second arms; and said first arm and said second arm terminate in first and second ring portions, respectively for engagement with said shaft.

3. A handle according to claim 2 in which the first arm and the second arm are of unequal length and the grip is disposed at an angle of the order of 25°–34° with respect to the longitudinal axis of the shaft.

4. A paddle according to claim 3 wherein said first and second means for coupling include at least one sleeve mounted on said shaft.

5. A paddle according to claim 4 includes means for permitting rotation of said shaft within said sleeve.

6. A paddle according to claim 5 in which said sleeve includes first and second sleeves, said first arm being connected to said first sleeve and said second arm being connected to said second sleeve.

7. A paddle according to claim 6 wherein said first and second sleeves are each a flanged collar rotatably mounted on said shaft.

8. A paddle according to claim 3 wherein said first and second means include at least one clamp about said shaft;

said first arm and said second arm terminate short of said shaft; and means for swingably coupling said first and second arms to said at least one clamp.

* * * * *